United States Patent [19]

Leivenzon et al.

[11] 4,234,033

[45] Nov. 18, 1980

[54] ROLLER DOOR AND FRAME COMBINATION

[75] Inventors: Simon Leivenzon; Steven Leivenzon, both of Caulfield, Australia

[73] Assignee: Firmaframe Nominees Proprietary Limited, Cheltenham, Australia

[21] Appl. No.: 18,005

[22] Filed: Mar. 7, 1979

[30] Foreign Application Priority Data

Mar. 8, 1978 [AU] Australia ..... 44213/78

[51] Int. Cl.[3] ..... E06B 9/08

[52] U.S. Cl. ..... 160/133

[58] Field of Search ..... 160/133, 201, 209, 235

[56] References Cited

U.S. PATENT DOCUMENTS

| | | | |
|---|---|---|---|
| 1,936,300 | 11/1933 | Guss | 160/133 |
| 2,495,963 | 1/1950 | Greegor | 160/235 |
| 2,767,787 | 10/1956 | Miller | 160/201 |
| 3,129,752 | 4/1964 | Whiting | 160/201 |
| 3,489,200 | 1/1970 | Recchione | 160/133 |
| 3,732,913 | 5/1973 | Wrono | 160/133 |
| 3,738,413 | 6/1973 | Frobosilo et al. | 160/235 |

*Primary Examiner*—Peter M. Caun

*Attorney, Agent, or Firm*—Schwartz, Jeffery, Schwaab, Mack, Blumenthal & Koch

[57] ABSTRACT

A roller door and frame combination is disclosed. The roller door has corrugations therein and the corrugations are maintained in the desired shape by flexible wearing strips at each side of the door and fastened to crests on one face of the door. The frame has channel members at each side in which the door slides. The channel members have a resilient friction surface therein which is arranged to engage with the face of the door which does not have the wearing strips fastened thereto and the friction surface is of such size as to restrain the door against lateral back and forth movement in the frame and provide controlled resistance to sliding of the door should the door thickness change.

6 Claims, 5 Drawing Figures

FIG. 2.
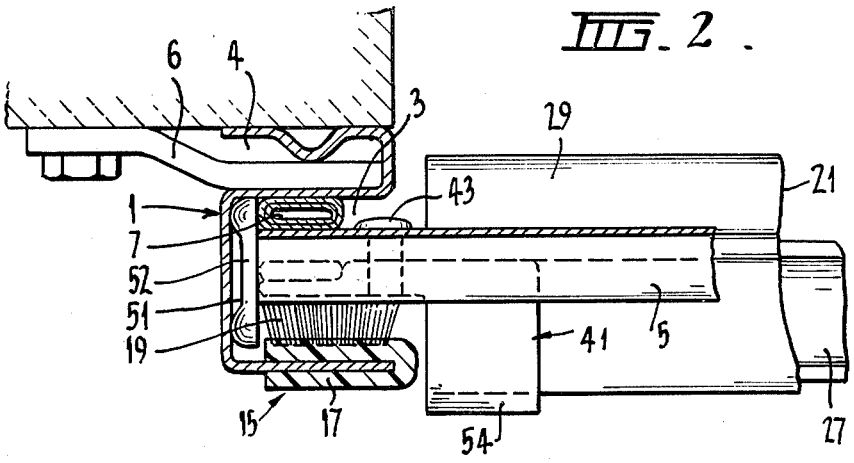
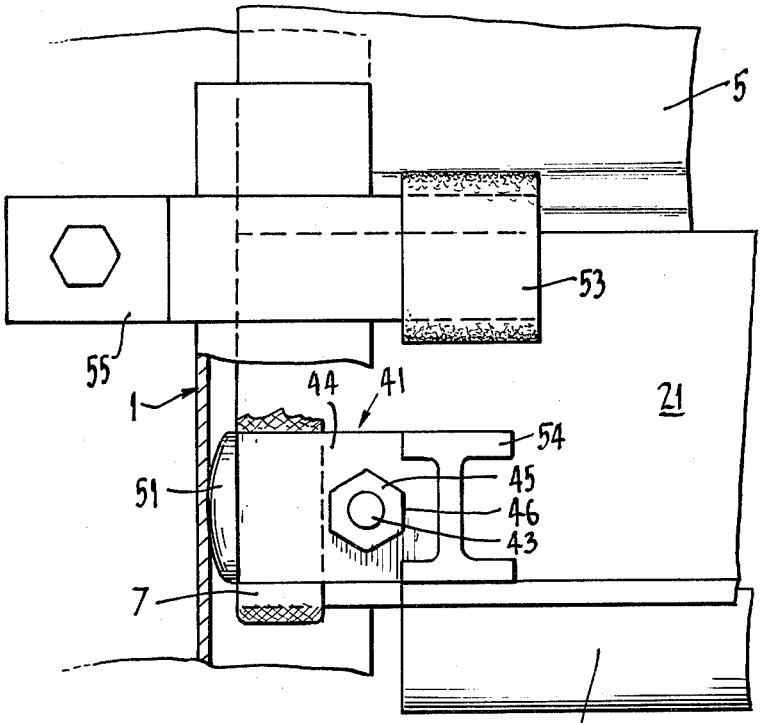
FIG. 5.

ROLLER DOOR AND FRAME COMBINATION

FIELD OF THE INVENTION

This invention relates to a roller door and frame combination and relates particularly but not exclusively to such for use in garages, sheds, factories and the like.

DESCRIPTION OF PRIOR ART

Hitherto there have been many proposals for roller shutter doors. Recently such doors have been made from a corrugated sheet metal curtain—the corrugations extending across the curtain from side to side—and in order to prevent stretching of the curtain lengthwise—top to bottom of the door—as it moves up and down in a door frame fixed to the sides of a door opening, there have been a pair of flexible tapes fastened to one face of the curtain at the respective side edges. The flexible tapes are known as wearing strips and extend continuously from the top to the bottom of the curtain and have a soft inner core of synthetic plastics material with an outer covering of woven nylon mesh. The inner cores of the wearing strips are substantially non-stretchable lengthwise, therefore, when fixed to the face of the curtain at each side edge, the curtain is inhibited from stretching lengthwise—top-to-bottom—as would occur when the corrugations tend to flatten as by sagging or by being damaged. The wearing strips are received within 'U' channels of the door frame and are substantially non-visable when viewing from the front of the door.

One known roller door has pairs of wearing strips fastened on the front face of the curtain as well as on the rear face of the curtain. The strips on the front face follow the corrugations whilst the strips on the rear face are substantially taut and extend across the corrugations. The pairs of strips on the front and rear faces are connected to the curtain at points where they are closest to one another. This arrangement is principally provided so that both the front and rear faces of the curtain have a resilient wearing strip thereon which can slidingly engage with the inside faces of 'U' shaped channel sections of the door frame in which the curtain is received. The width of the 'U' shaped channels are chosen to correspond to the thickness of the curtain including the front and rear strips. Thus, the curtain has no metal to metal contact with the 'U' shaped channel sections and therefore it can slide easily therein and be substantially tightly received therein to resist back and forth movement and thereby inhibiting rattling as would be caused by gusts of wind blowing against the curtain.

A problem with the above type of door is that after a period the outer woven mesh wears and then either the overall thickness of the curtain and the strips is less than the distance between the arms of the 'U' shaped channel section frame and the curtain rattles in the wind or alternatively the mesh wears completely through and the ends of the woven mesh double over, and thus the thickness of the curtain and the strips is greater than the distance between the arms of the 'U' shaped channel section frame. Increased resistance to the sliding of the curtain is then experienced. In certain instances the resistance can be such that when an automatic door opening and closing mechanism is used, the curtain is unable to be opened or closed. This occurs if the mechanism is of the type which operates by rotating a drum onto which the curtain is wound, because when the curtain is being unwound and the resistance becomes too great, the reversing sensors in the opening and closing mechanism sense such resistance as an object under the curtain and the curtain is then automatically reopened. The curtain must then be manually operated to close it. Alternatively, if the reversing sensors do not operate, or are not fitted, and the resistance to closing becomes too great, then the drum continues to unwind and because the curtain is prevented from sliding in the door frame by the increased resistance, the curtain is usually permanently damaged by buckling.

SUMMARY OF THE INVENTION

The present invention attempts to overcome one or more of the above problems by providing a resilient friction surface in the frame members for engaging the face of the curtain. The resiliency of the surface allows for controlled resistance to be applied to the movement of the curtain in the frame should the curtain wear or its thickness otherwise change.

According to the present invention there is provided a roller door and frame combination, said roller door being of the type comprising at least one curtain with a plurality of parallel spaced-apart corrugations arranged parallel with the axis of rolling of the curtain, the frame being of the type having elongate channel members for slidably receiving each side edge of the curtain over a major length of the height of the door opening and wherein the curtain is maintained in its corrugated shape by flexible wearing strips of material fastened to crests on one face of the curtain, at least one wearing strip being near one side edge of the curtain, and at least another being near the other side edge of the curtain, characterized in that there is resilient friction surface carried by the channel members for engaging with the face of the curtain which does not have the wearing strips fastened thereto and being of such size as to restrain the door against lateral back and forth movement in the frame and provide controlled resistance to sliding of the curtain within the channel members should the curtain thickness change.

Most preferably the resilient friction surface is of 'woven poly pile' material. Such material is referred to in detail hereinafter.

Desirably a further wearing means is carried by the curtain and projects from each side of the curtain to engage the channel members to restrain the curtain against transverse side-to-side movement in the frame.

BRIEF DESCRIPTION OF THE DRAWINGS

In order that the invention can be more clearly ascertained the construction of a preferred embodiment will now be described with reference to the accompanying drawings wherein:

FIG. 2 is a plan section view taken in the direction of arrows 2—2 shown in FIG. 2, FIG. 5 is a rear view of the door, on an enlarged scale, at one edge, when the door is in the raised position.

DESCRIPTION OF THE PREFERRED EMBODIMENT

Figure 1:
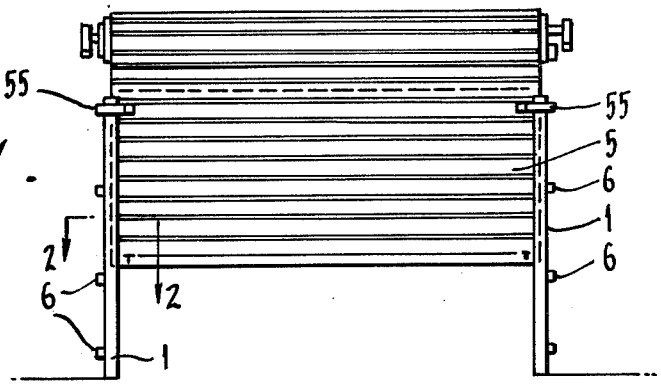
FIG. 1 is a rear view of the curtain, door frame all fitted in a door opening.

The frame 1 of the door is of rolled metal section of generally 'S' shaped channel as shown. The frame 1 has an opening 3 which receives a portion of the sides of the roller door curtain 5. The frame 1 also has an opening 4 which receives lugs 6 which are in turn used to clamp the frame 1 around the door opening by being bolted to the material around the opening. The curtain 5 has a plurality of corrugations rolled formed therein; the corrugations being substantially parallel with the axis of rolling of the curtain 5. The corrugations form crests and troughs in the curtain. On one face of the curtain at each side edge there is a wearing strip 7 attached thereto. The wearing strip 7 is attached by riveting or stapling to the crests on one face by rivets or staples 9. The wearing strip 7 extends throughout the length (height) of the curtain and prevents stretching of the curtain as by the corrugations flattening. The wearing strips 7 have a resilient inner plastics material core and a nylon woven cord outer covering thereon.

A resilient friction surface 15 in the form of a strip and known as "woven poly pipe weather seal" and manufactured by Schlegel Pty. Ltd. of 565 Harris St., Ultimo Broadway, N.S.W., Australia, is provided and fastened to the frame 1 so as to provide a resilient friction surface for engaging the opposite face of the curtain 5. The strip 15 has a plastics material portion 17 of generally "U" shape cross section with a plurality of bristles 19 embedded on one outer face thereof. The strips 15 are a press fit over an edge of the frame 1 (see FIG. 2) and are fixed thereto as by gluing. The strips 15 extends the height of the door frame 1. The other side edge of the curtain and frame is identical.

In use, when the curtain 5 is to roll up or down, the wearing strip 7 prevents the curtain from stretching, as would happen if tension were applied to the top and bottom of the curtain causing the corrugations to flatten and it also provides a resilient means for engaging with the inside of the door frame 1 whereby to allow for smooth sliding engagement therewith and a resilient means to allow for slight compression so as to ride over surface undulations which may be on the inside of the frame 1. The strip means 15 with its bristles provides a resilient means which applies a light pressure against the face of the curtain 5 by flexing of the bristles and urging the wearing strip 7 against the inside of the frame 1. Such pressure provides controlled resistance to the movement of the curtain 5 in the frame. The resistance is maintained substantially constant even if the thickness of the curtain should change marginally as by wearing of the strips 7 during use. It will be appreciated that the bristles of the strips 15 are resilient and flexible and that the dimensions of the channel are chosen so that the bristles slightly bend and apply a small resilient force to the curtain 5 as a result of their resiliency. Because the bristles are always in a bent condition when they engage the curtain 5 a controlled friction resistance is applied to the curtain 5 even if the thickness of the curtain should change marginally. Also the strips 15 are such that the curtain is prevented from lateral movement back and forth within the frame 1, thereby inhibiting the curtain 5 from rattling in its frame 1 in heavy winds.

The bottom of the curtain 5 has an aluminum extrusion foot 21 fitted thereto. The foot 21 has an upwardly inclined slot 23 therein (see FIG. 4) in which the bottom edge portion of the curtain 5 is received. The foot 21 has two spaced apart grooves 25 at the bottom thereof in which a resilient material weather seal 27 for the curtain 5 is received. The weather seal is to butt against the floor under the curtain 5 when the curtain 5 is in the closed position. The weather seal 27 is made of flexible plastics material so that it will closely follow surface undulations in the floor.

Figure 4:
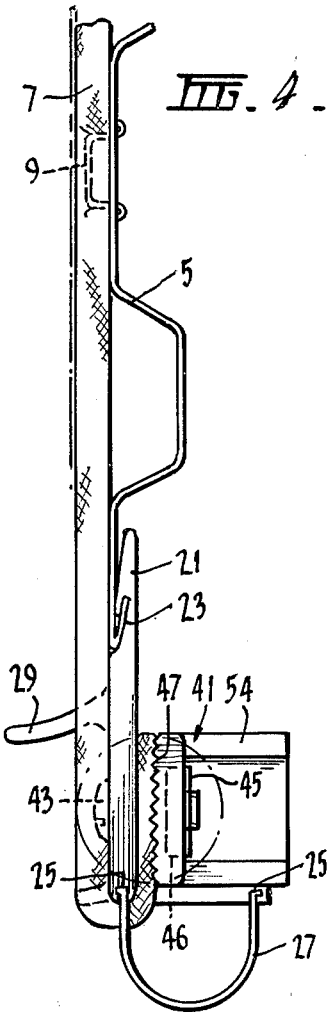
FIG. 4 is a side view taken in the direction of arrows 4—4 shown in FIG. 3.

As shown in FIG. 4 the foot 21 has a handle portion 29 extending therefrom and the handle portion 29 is removed at the extreme side edges of the curtain 5 where the curtain 5 is received in the frame 1.

Figure 3:
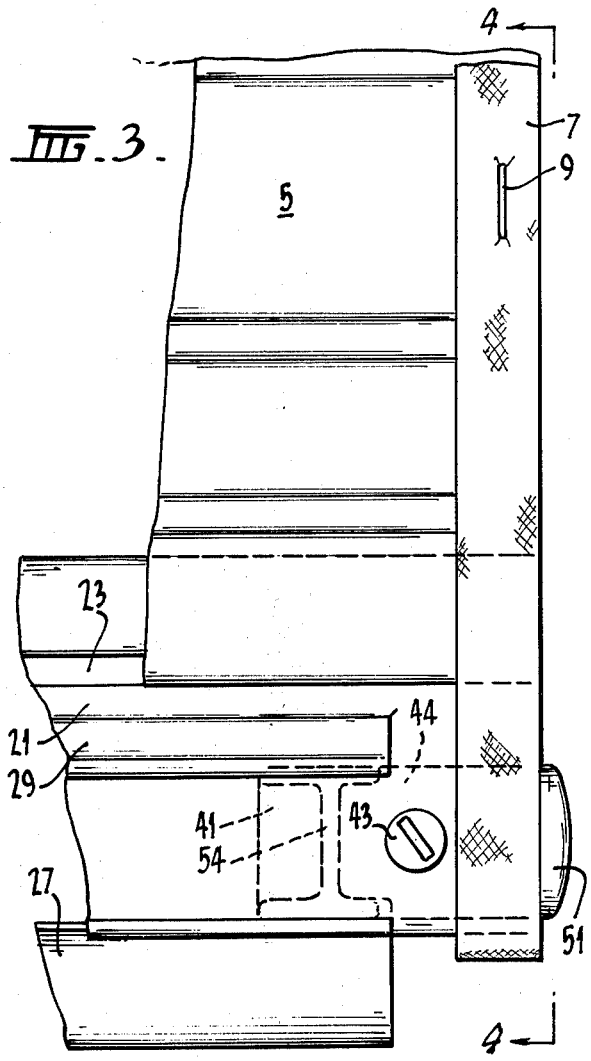
FIG. 3 is a front view, on an enlarged scale, of a side of the curtain.

The tail of the wearing strip 7 extends downwardly past the foot 21 and returns on the rear face of the curtain 5. (see FIG. 3). The tail of the wearing strip 27 is clamped to the foot 21 by a blockmember 41 which in turn is held to the foot 21 by a screw 43 and nut 45.

The block member 41 is made of Nylon and has a generally planar main body part 44, the rear surface of which has a recess 46 therein for receiving the nut 43. The inside face of the main body part has a plurality of transversely extending saw tooth corrugations 47 therein. The depth of the recess 45 and the dimensions of the corrugations are such that the wearing strip 7 will be rigidly clamped to the foot 21 when the block member 44 is in turn clamped to the foot 21. The block member 41 is fastened to the foot 21 it will project past the side edge of the curtain 5 (see FIG. 3 and FIG. 5) and lightly engage with the inside face of the opening 3 of the frame 1. This prevents transverse side to side movement of the curtain 5 within the frame 1. The domed stud 51 has a scolloped out portion 52 (see FIG. 2) which extends from top to bottom of the stud 51. The scolloped out portion 52 minimises the area of contact of the stud 51 with the inside face of the opening 3 compared to that of a flat headed stud or of a domed stud with a large radius. Thus the sliding friction to movement of the curtain is maintained low. The block member 41 has an "I" shaped extension 51 extending outwardly from the main body 44. The extension 51 is arranged to extend to be close to the frame 1 (see FIG. 2) and is provided to abutt with a stop means 53 fastened near the top of the frame 1 to prevent the curtain 5 from rolling out of the frame 1 when it is rolled up. The stop means 53 comprises a rubber buffer fitted onto a lug member 55 which is fastened to the material around the door opening in the position as shown or alternatively is fastened directly to the frame at the required position.

We claim:

1. A roller door and frame combination, said roller door being of the type comprising at least one curtain with a plurality of parallel spaced-apart corrugations arranged parallel with the axis of rolling of the curtain, the frame being of the type having elongate channel members for slidably receiving each side edge of the curtain over a major length of the height of the door opening and wherein the curtain is maintained in its corrugated shape by flexible wearing strips of material fastened to crests on one face of the curtain, at least one wearing strip being near one side edge of the curtain, and at least another being near the other side edge of the curtain, characterized in that there is resilient friction surface carried by the channel members for engaging with the face of the curtain which does not have the wearing strips fastened thereto and being of such size as to restrain the door against lateral back and forth movement in the frame and provide controlled resistance to sliding of the curtain within the channel members should the curtain thickness change.

2. The combination as claimed in claim 1 wherein the resilient friction surface comprises resilient bristles which are of such length, that they are bent where they engage the curtain whereby to provide the friction surface.

3. The combination as claimed in claim 2 wherein the bristles extend from a bristle backing means which is shaped to slide fit onto an edge of the channel members.

4. The combination as claimed in claim 1 wherein said flexible wearing strips are terminated at the bottom of the curtain by passing under the bottom and a short way up said face of the curtain that does not have said flexible wearing strips fastened thereto, and by the ends at the bottom being clamped between the curtain and a respective block member which in turn is fastened to said curtain.

5. A roller door combination, said roller door being of the type comprising at least one curtain with a plurality of parallel spaced-apart corrugations arranged parallel with the axis of rolling of the curtain, the frame being of the type having elongate channel members for slidable receiving each side edge of the curtain over a major length of the height of the door opening and wherein the curtain is maintained in its corrugated shape by flexible wearing strips of material fastened to crests on one face of the curtain, at least one wearing strip being near one side edge of the curtain, and at least another being near the other side edge of the curtain, characterized in that there is resilient friction surface carried by the channel members for engaging with the face of the curtain which does not have the wearing strips fastened thereto and being of such size as to restrain the door against lateral back and forth movement in the frame and provide controlled resistance to sliding of the curtain within the channel members should the curtain thickness change and wherein the resilient friction surface comprises resilient bristles which are of such length, that they are bent where they engage the curtain whereby to provide the friction surface and wherein said flexible wearing strips are terminated at the bottom of the curtain by passing under the bottom and a short way up said face of the curtain that does not have said flexible wearing strips fastened thereto, and by the ends at the bottom being clamped between the curtain and a respective block member which in turn is fastened to said curtain and wherein said block member has a projection extending therefrom which extends past the side of the curtain at the edge which it is closest, said projection lightly engaging the bottom of the channel and preventing side to side movement of the curtain in the frame.

6. The combination as claimed in claim 3 or 4 wherein said block member has a further projection extending therefrom, provided for engaging with a stop means, in use, situated near the top of the frame for preventing the curtain from sliding out of the frame when the curtain is being opened.

* * * * *